United States Patent [19]

Wang

[11] Patent Number: 4,717,053

[45] Date of Patent: Jan. 5, 1988

[54] EXTENDIBLE AND FOLDABLE GARMENT HANGER

[76] Inventor: Kuo-Ru Wang, No. 31, Nan-An Tsun, An-Ting Hsiang, Tainan Hsien, Taiwan

[21] Appl. No.: 33,510

[22] Filed: Apr. 1, 1987

[30] Foreign Application Priority Data

Feb. 19, 1987 [TW] Taiwan ..... 76201453

[51] Int. Cl.[4] ..... A47G 25/40

[52] U.S. Cl. ..... 223/94; 211/118

[58] Field of Search ..... 223/89, 90, 94, 95; 211/118

[56] References Cited

U.S. PATENT DOCUMENTS

| | | | |
|---|---|---|---|
| 2,448,234 | 8/1948 | Pandele | 223/94 |
| 2,814,426 | 11/1957 | Miller | 223/94 |
| 4,168,791 | 9/1979 | Clark, Jr. | 223/94 |

FOREIGN PATENT DOCUMENTS

| | | | |
|---|---|---|---|
| 11662 | 12/1908 | Denmark | 223/94 |
| 631388 | 9/1927 | France | 223/94 |
| 31896 | 3/1965 | German Democratic Rep. | 223/95 |
| 806958 | 1/1959 | United Kingdom | 223/95 |

*Primary Examiner*—Robert R. Mackey
*Attorney, Agent, or Firm*—Ladas & Parry

[57] ABSTRACT

An extendible and foldable miniature garment hanger which includes a pair of novel hanger arms. The novel hanger arms are extendible and retractable so that the garment hanger is suitable for hanging garments of various sizes. Furthermore, the novel hanger arms are pivotally mounted on a base so that they may be folded together when the garment is in an idle condition.

4 Claims, 5 Drawing Figures

EXTENDIBLE AND FOLDABLE GARMENT HANGER

BACKGROUND OF THE INVENTION

The present invention relates to a garment hanger, and more particularly to one with a pair of extendible and retractable hanger arms which can be folded together to form a miniature structure when the garment hanger is in an idle condition.

Common garment hangers are generally classified into three types: (1) a hanger of wire with a plastic coating; (2) a plastic hanger; and (3) a wooden hanger.

All of the conventional hangers referred to above have a pair of hanger arms which are in a fixed form so that they suffer from the following disadvantages:

1. The hanger of a fixed size may be unsuitable for hanging garments of different sizes. In particular, a fixed size hanger can only be suitable for either the garments of an adult or those of a child. When a garment is hung on an unsuitable sized hanger, the results are unsightly and cause damage to the garment.

2. In storage and transport, the hanger takes up a great deal of space. Generally, its maximum length is about 39 cm, and its maximum width is about 19cm.

SUMMARY OF THE INVENTION

It is therefore an object of the present invention to provide a garment hanger comprising a pair of extendible and retractable hanger arms, which is suitable for hanging garments of various sizes.

It is therefore another object of the present invention to provide a garment hanger with a pair of pivotally mounted hanger arms which can be folded together to minimize the total volume of the garment hanger.

According to the present invention, the garment hanger includes a base, a hook connected to the upper end of the base, a pair of opposed main arms connected to the opposed sides of the base, and a pair of extension arms respectively received in the main arms and extendible partially out of the outer ends of the main arms. The extension arms can be selectively positioned at several points along the main arms so as to be suitable for hanging garments of various sizes.

The main arms are pivotally connected to the base. Projecting from the base are a pair of support rods which are located below the pivots of the main arms and which are further from the center of the base than the pivots. Thus, the pivotally connected main arms will be supported on the support rods causing the orientation of the main arms relative to the base to be fixed. At this time, the garment is of a fixed form for use. When the garment hanger is idle, the main arms can be rotated to be adjacent to each other, thereby minimizing the total volume of the garment hanger.

BRIEF DESCRIPTION OF THE DRAWINGS

Other features and advantages of the present invention will be apparent from the following detailed description of a preferred embodiment of the present invention with reference to the accompanying drawings, in which.

DETAILED DESCRIPTION OF THE PREFERRED EMBODIMENT

Figure 1:
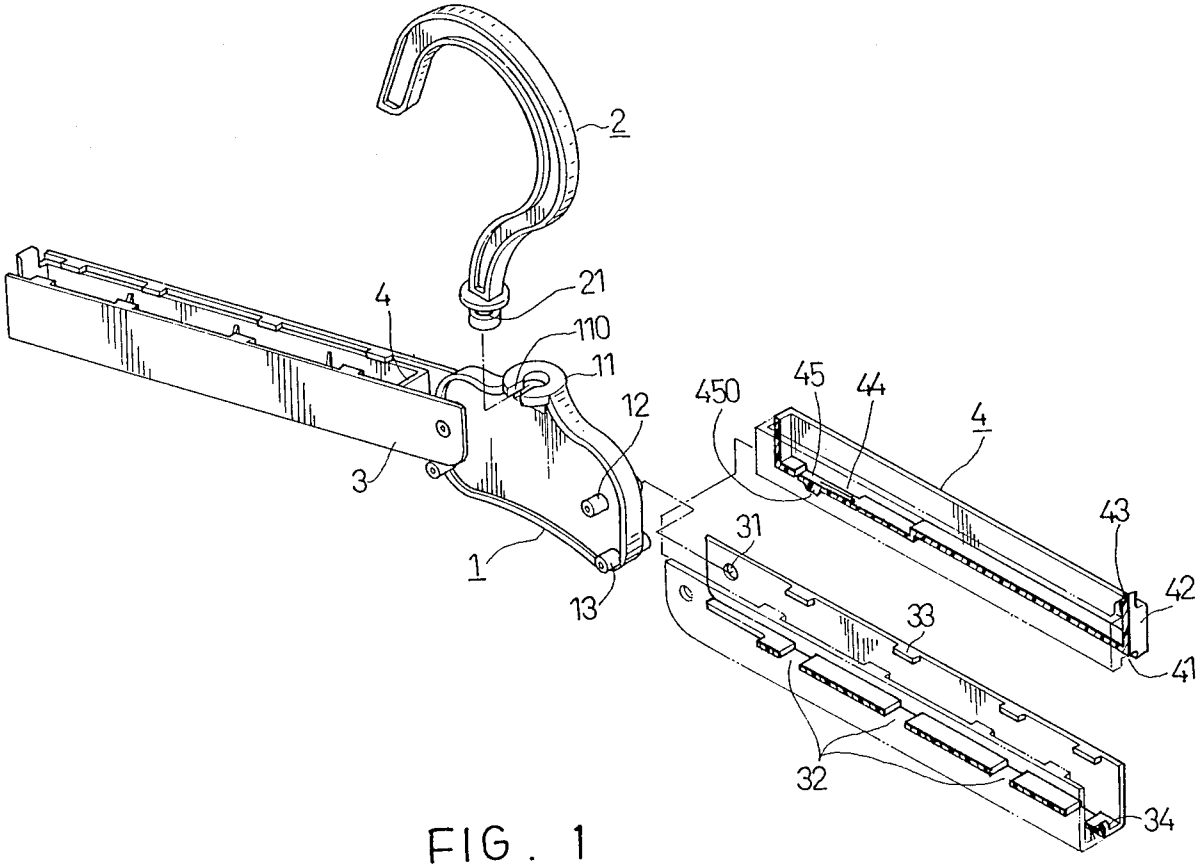
FIG. 1 is an exploded view of an extendible and foldable garment hanger according to the present invention.
Figures 2, 3:
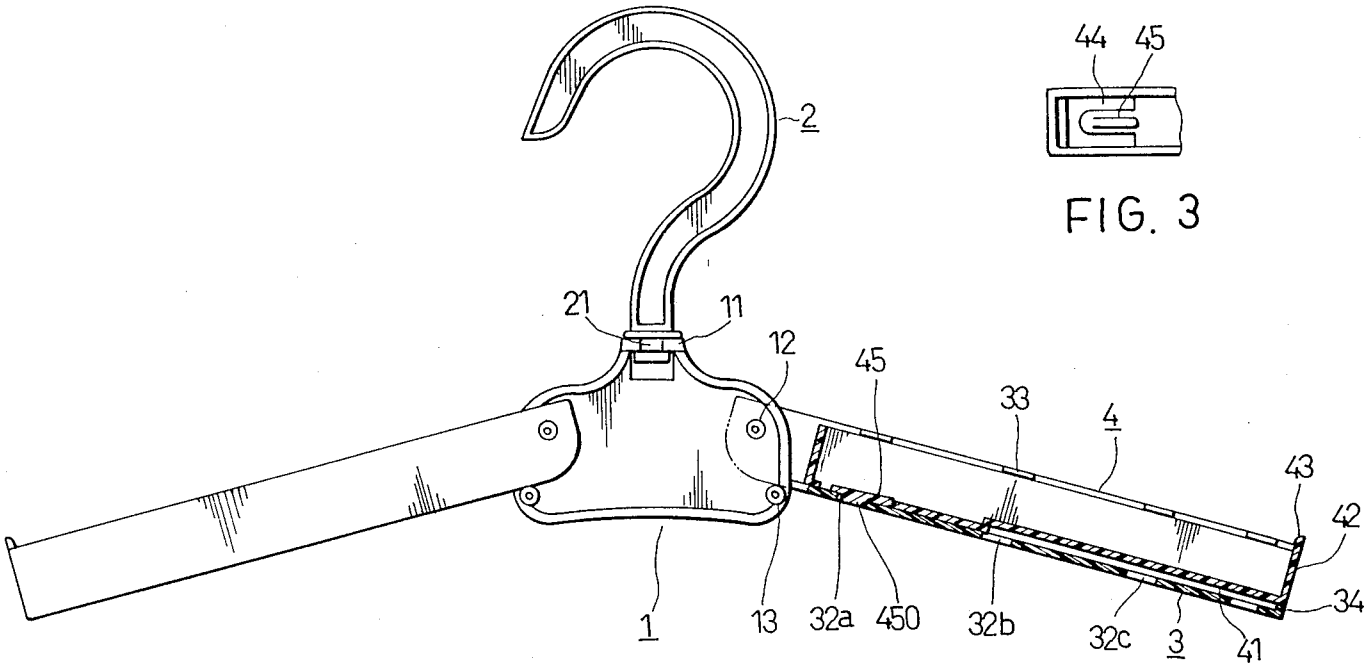
FIG. 2 is a partially sectional view showing the garment hanger of the present invention, illustrating a state that the extension arms are completely received within the main arms.
FIG. 3 is a fragmental top view showing an extension arm of the garment hanger of the present invention.

Referring to FIG. 1 with reference to FIG. 2, a plastic garment hanger according to the present invention includes an upright base 1, a hook 2, a pair of main arms 3, and a pair of extension arms 4.

The base 1 includes a C-shaped holder 11 having a gap 110 at the upper end of the base 1, a pair of pivots 12 projecting horizontally from the base 1 near two opposed sides of the base 1, and a pair of support rods 13 projecting horizontally from the base 1 on two lower corners.

The hook 2 includes a neck 21 provided on the lower end portion thereof for being retained rotatably within the C-shaped holder 11 of the base 1.

The main arm 3 is of a generally U-shaped cross-section so as to form a channel for receiving one of the extension arms 4 therein. It has a pair of pivot holes 31 respectively provided in the inner ends of the side walls thereof for being pivotally mounted on the pivot 12. When the main arms 3 are pivotally connected to the base 1, they will abut on the support rods 13 by the pull of gravity causing the orientation of the main arms 3 relative to the base 1 to be fixed as shown in FIG. 2. Further provided are three recesses 32 in the upward surface of the bottom wall, eight aligned block sheets 33 extending horizontally from the upper ends of the side walls in two rows, and a limit stop 34 projecting upwardly from the outer end of the upward surface of the bottom wall. It should be understood that the block sheets 33 are used to prevent the extension arm 4 from upward movement out of the channel of the main arm 3.

The extension arm 4 is also upwardly open. It has a slot 41 provided in the bottom surface thereof and open at the outer end thereof for receiving the limit stop 34 of the main arm 3 therein. Projecting upwardly from the the central portion of the upper end of the outer end wall 42 of the extension arm 4 is a push-pull sheet 43 for moving the extension arm 4 by hand to slide along the channel of the main arm 3. As best seen from FIG. 3, a u-shaped portion 44 of the bottom wall of the extension arm 4 is hollowed out to form a strip 45 having a tapered bump 450 (see FIG. 2) projecting downwardly from the strip 45. When the bump 450 slides into one of the recesses 32, the extension arm 4 is positioned in the main arm 3. And, when the extension arm 4 is moved by hand through the push-pull sheet 43, the bump 450 will be easily moved away from the recess 32 because the bump 450 is tapered.

In assembly of the base 1, the main arms 3, and the extension arms 4, the extension arms 4 are first inserted into the main arms 3 through the pivoted ends of the main arms 3. The main arms 3 are then pivotally mounted on the pivots 12 of the base 1.

In use, depending on the size of the garment to be hung, the extension arms 4 will be moved so that the bumps 450 of the extension arms 45 engage in selected ones of the recesses 32, thus determining the suitable distance between the main arms 3 and the outer ends of the extension arms 4. It is noted that when the bump 450 engages in the innermost recess 32*a*, the extension arm 4 is completely received within the main arm 3. Then, when the extension arm 4 is moved outwardly, the bump 450 will move away from the recess 32*a* so that the resilient strip 45 is flexed until the bump 450 slides into the intermediate recess 32*b*.

Figure 4:
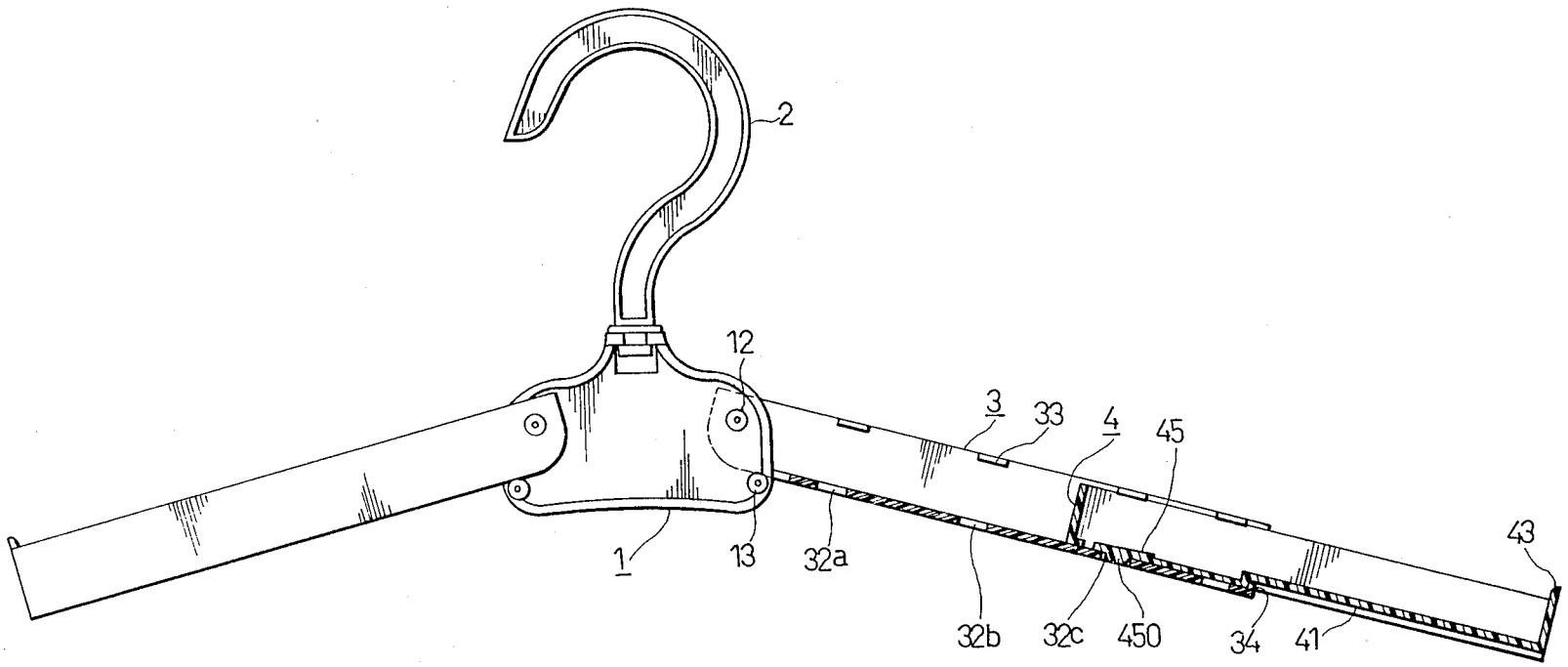
FIG. 4 is another partially sectional view showing the garment hanger of the present invention, illustrating a state that one of the extension arms are partially extended out of the corresponding main arm.

Similarly, the extension arm 4 can be moved outwardly again so that the bump 450 engages in the outermost recess 32*c*, as shown in FIG. 4. At this time, the end wall of the slot 41 of the extension arm 4 abuts on the limit stop 34 so tht the extension arm 4 is obstructed from further outward movement by the limit stop 34. The extension arm 4 is thus prevented from outward movement of the main arm 3.

Figure 5:
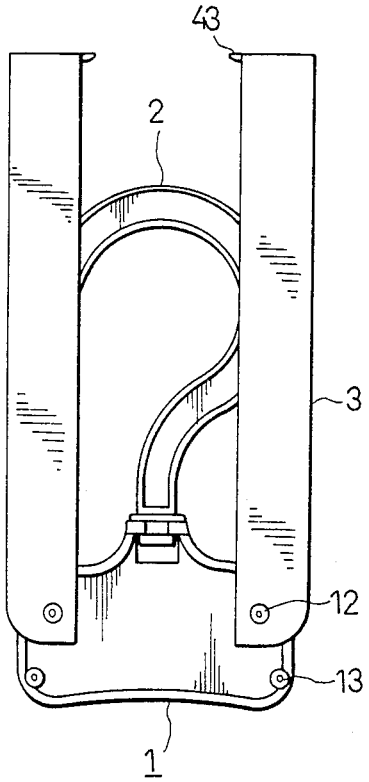
FIG. 5 is a front elevational view showing the garment hanger of the present invention in folded condition.

When the garment hanger is idle, the extension arms 4 are completely retracted into the main arms 3. Then, the main arms 3 are rotated to assume in a parallel relationship, as shown in FIG. 5. In the parallel idle condition of the main arms 3, the base 1 and the hook 2 are partially received in the main arms 3. The folded garment hanger has a maximum length of only 13 cm and a maximum width of only 6 cm. This largely reduces the total volume of the garment hanger in comparison to conventional garment hangers.

With the present invention thus explained, it is apparent that various modifications and variations can be made without departing from the scope and spirit of the present invention. It is therefore intended that the present invention be limited as indicated in the appended claims.

I claim:

1. An extendible and foldable garment hanger comprising:

a base having an upper end and opposed sides with a pair of support rods respectively projecting from said base near the opposed sides of said base;

a hook rotatably connected to the upper end of said base;

a pair of opposed main arms, respectively pivotally connected to the opposed sides of said base in such a manner that the two pivot points thereof are located above said support rods and closer to the center of said base than said support rods, supported on and above said support rods so that the orientation of the main arms relative to said base is fixed, each of said main arms having a channel provided lengthwise therein having side walls and a bottom wall and a plurality of engagement recesses provided in the upward surface of the bottom wall of said main arm along said channel, each of said channels being open upwardly and open at the free end thereof;

a pair of extension arms, an extension arm respectively received within said channel of one of said main arms and slidable partially out of the open end of said channel at the free end of said main arm, each of said extension arms including a groove provided in the upper surface thereof and a resilient strip integral with said extension arm, each of said resilient strips including an engagement bump integral therewith for being engaged in selected ones of said engagement recesses;

whereby, as desired, the distance between the outer ends of said extension arms can be varied by engagement of said bumps of said extension arms with selected ones of said recesses of said main arms depending on the size of the garment to be hung; when the garment hanger is idle, said main arms can be rotated at the pivot points so that each of said grooves of said extension arms catch at least a portion of said hook therein while permitting said extension arms to retract back to the inside of said main arms;

each of said main arms including a plurality of block sheets horizontally inwardly projecting from the upper ends of the side walls thereof so as to prevent said extension arm received in said main arm from upward movement out of said channel of said main arm;

each of said extension arms having a bottom surface with a slot extending from an intermediate portion of said bottom surface to the outer end of said bottom surface, and wherein each of said main arms has a limit stop projecting upwardly from the outer end of the upward surface of the bottom wall of said main arm and received within said slot for preventing said extension arm received therein from outward movement out of said channel of said main arm.

2. An extendible and foldable garment hanger as claimed in claim 1, wherein each of said extension arms has a push-pull sheet projecting upwardly from the outer end of the upper surface thereof for moving it by hand to slide along said channel of said corresponding main arm.

3. An extendible and foldable garment hanger as claimed in claim 1, wherein said engagement bumps of said extension arms are tapered so as to be easily moved away from said extension recesses of said main arms.

4. An extendible and foldable garment hanger as claimed in claim 1, wherein said hook has a neck provided on the lower end portion thereof, and wherein said base has a C-shaped holder provided on the upper end thereof for retaining rotatably said neck of said hook therein.

* * * * *